US008989991B2

(12) United States Patent
Kim et al.

(10) Patent No.: US 8,989,991 B2
(45) Date of Patent: Mar. 24, 2015

(54) APPARATUS AND METHOD FOR PROCESSING FUEL CUT

(75) Inventors: Young Back Kim, Daegu (KR); Hae Dong Lee, Daegu (KR); Kee Koo Kwon, Daegu (KR); Gwang Su Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 81 days.

(21) Appl. No.: 13/540,082

(22) Filed: Jul. 2, 2012

(65) Prior Publication Data

US 2013/0146022 A1 Jun. 13, 2013

(30) Foreign Application Priority Data

Dec. 8, 2011 (KR) ..... 10-2011-0131034

(51) Int. Cl.
*F02D 41/12* (2006.01)
*F02D 41/02* (2006.01)
*F02D 11/10* (2006.01)

(52) U.S. Cl.
CPC ..... *F02D 41/021* (2013.01); *F02D 11/106* (2013.01); *F02D 41/123* (2013.01); *F02D 2200/602* (2013.01); *F02D 2200/702* (2013.01)
USPC ..... 701/110; 123/333; 123/198 DB; 123/481; 123/482; 123/493

(58) Field of Classification Search
USPC ..... 123/333, 493, 682, 198 DB, 481; 701/110
See application file for complete search history.

(56) References Cited

U.S. PATENT DOCUMENTS

| | | | | |
|---|---|---|---|---|
| 6,076,036 | A * | 6/2000 | Price et al. | 701/93 |
| 6,571,768 | B1 * | 6/2003 | Nishiyama | 123/406.5 |
| 7,089,103 | B2 * | 8/2006 | Katakura et al. | 701/54 |
| 7,801,656 | B2 * | 9/2010 | Alvarez et al. | 701/70 |
| 8,165,774 | B2 * | 4/2012 | Wang et al. | 701/93 |

FOREIGN PATENT DOCUMENTS

JP 2005-256668 9/2005

* cited by examiner

*Primary Examiner* — Erick Solis
(74) *Attorney, Agent, or Firm* — Staas & Halsey LLP

(57) ABSTRACT

Disclosed are an apparatus and a method for processing a fuel cut starting or releasing the fuel cut using a tilt angle of a vehicle or a clearance angle of an acceleration pedal. An exemplary embodiment of the present invention can reflect driving habit or acceleration intention of a driver by interlocking a clearance angle of the acceleration pedal in addition to starting or releasing a fuel cut according to a tilt angle of a vehicle, thereby increasing fuel efficiency driving or convenience of driving. The exemplary embodiment of the present invention can improve stability of driving by applying a haptic technology.

16 Claims, 5 Drawing Sheets

DRAWINGS

APPARATUS AND METHOD FOR PROCESSING FUEL CUT

CROSS-REFERENCE TO RELATED APPLICATIONS

This application claims priority to and the benefit of Korean Patent Application No. 10-2011-0131034 filed in the Korean Intellectual Property Office on Dec. 8, 2011, the entire contents of which are incorporated herein by reference.

TECHNICAL FIELD

The present invention relates to an apparatus and a method for staring or releasing a fuel cut, and more specifically, to an apparatus and a method for staring or releasing a fuel cut of a vehicle.

BACKGROUND ART

Driving on a tilt road is a section optimal for a fuel operation due to an increase in acceleration. In this case, it is possible to actively and rapidly enter a fuel cut mode in consideration of RPM and a tilt angle. The related art has proposed various components for reducing fuel of a vehicle in the inclined road. One of components that have been proposed in the related art is a tilt sensitive fuel cut valve. The component is a ball value that is sensitive to a tilt of a vehicle so as to be displaced from a valve opening position to a valve closing position. The ball valve cuts a supply of fuel from a fuel tank to a fuel injection device. However, the component starts and releases a fuel cut by using only a vehicle tilt angle due to a mechanical configuration and does not reflect driving habit or acceleration intention of a driver, which cannot improve convenience of driving.

SUMMARY OF THE INVENTION

The present invention has been made in an effort to provide an apparatus and a method for processing a fuel cut capable of starting or releasing a fuel cut using a vehicle tilt angle and a clearance angle of an acceleration pedal.

An exemplary embodiment of the present invention provides an apparatus for processing a fuel cut, including: a vehicle tilt measuring unit configured to measure a vehicle tilt showing an inclined degree of a vehicle; an accelerator pressurization measuring unit configured to measure a degree in which an accelerator of the vehicle is pressurized or accelerator pressurization indicating a clearance angle of the accelerator; and a fuel cut control unit configured to control the fuel cut for the vehicle by using the measured vehicle tilt and the measured accelerator pressurization.

The fuel cut control unit may control the fuel cut so as to start the released fuel cut or controls the fuel cut so as to release the starting fuel cut.

The fuel cut control unit may include: a first determining unit configured to compare the measured vehicle tilt with a predetermined first reference value to determine whether the measured vehicle tilt is the first reference value or more; a second determining unit configured to compare the measured accelerator pressurization with a predetermined second reference value when the measured vehicle tilt is the first reference value or more to determine whether the measured accelerator pressurization is less than the second reference value or more; and a fuel cut releasing unit configured to control the fuel cut so as to release the starting fuel cut when the measured acceleration pressurization is less than the second reference value.

The fuel cut control unit may further include: a fuel cut starting unit configured to control the fuel cut so as to start the released fuel cut when the measured vehicle tilt is less than the first reference value or the measured accelerator pressurization is the second reference value or more.

The fuel cut control unit may include: a third determining unit configured to compare the measured acceleration pressurization with a predetermined second reference value to determine whether the measured accelerator pressurization is the second reference value or more; and a fuel cut releasing unit configured to control the fuel cut so as to release the starting fuel cut when the measured accelerator pressurization is the second reference value or more.

The fuel cut control unit may further include: a fourth determining unit configured to compare the measured vehicle tilt with the predetermined first reference value when the measured accelerator pressurization is less than the second reference value to determine whether the measured vehicle tilt is the first reference value or more; and a fuel cut starting unit configured to control the fuel cut so as to start the released fuel cut, wherein the fuel cut releasing unit controls the fuel cut so as to release the fuel cut when the measured vehicle tilt is the first reference value or more, and the fuel cut starting unit controls the fuel cut so as to start the fuel cut when the measured vehicle tilt is less than the first reference value.

The vehicle tilt measuring unit may measure the vehicle tilt based on a vehicle tilt angle to a gravity direction by using at least one of a tilt sensor attached to a body or wheel of the vehicle, a tilt angle sensor mounted in the vehicle, and a gravity sensor attached to a handle of the vehicle.

The accelerator pressurization measuring unit may measure the accelerator pressurization by using the pressure sensor attached to one surface of the accelerator to which body wearing is touched or the gravity sensor attached to one side of the accelerator.

The apparatus may further include: a data storage unit configured to store, as data, a clearance angle allowable range of the accelerator to each vehicle tilt; a fifth determination unit configured to determine whether a clearance angle measured every time the vehicle tilt and the clearance angle of the accelerator are measured is in a clearance angle allowable range to the measured vehicle tilt; and a haptic unit configured to move the accelerator when the measured clearance angle is out of the clearance angle allowable range to the measured vehicle tilt.

The haptic unit may move the accelerator when the released fuel cut starts.

Another exemplary embodiment of the present invention provides a method for processing a fuel cut, including: measuring a vehicle tilt showing an inclined degree of a vehicle; measuring a degree in which an accelerator of the vehicle is pressurized or accelerator pressurization indicating a clearance angle of the accelerator; and controlling the fuel cut for the vehicle by using the measured vehicle tilt and the measured accelerator pressurization.

The controlling of the fuel cut may include: a first determining step of comparing the measured vehicle tilt with a predetermined first reference value to determine whether the measured vehicle tilt is the first reference value or more; a second determining step of comparing the measured accelerator pressurization with a predetermined second reference value when the measured vehicle tilt is the first reference value or more to determine whether the measured accelerator pressurization is less than the second reference value or more;

and a fuel cut releasing step of controlling the fuel cut so as to release the starting fuel cut when the measured acceleration pressurization is less than the second reference value.

The controlling of the fuel cut may further include: a fuel cut starting step of controlling the fuel cut so as to start the released fuel cut when the measured vehicle tilt is less than the first reference value or the measured accelerator pressurization is the second reference value or more.

The controlling of the fuel cut may include: a third determining step of comparing the measured acceleration pressurization with a predetermined second reference value to determine whether the measured accelerator pressurization is the second reference value or more; and a fuel cut releasing step of controlling the fuel cut so as to release the starting fuel cut when the measured accelerator pressurization is the second reference value or more.

The controlling of the fuel cut may further include: a fourth determining step of comparing the measured vehicle tilt with the predetermined first reference value when the measured accelerator pressurization is less than the second reference value to determine whether the measured vehicle tilt is the first reference value or more; and a fuel cut starting step of controlling the fuel cut so as to start the released fuel cut, wherein the fuel cut releasing step controls the fuel cut so as to release the fuel cut when the measured vehicle tilt is the first reference value or more, and the fuel cut starting step controls the fuel cut so as to start the fuel cut when the measured vehicle tilt is less than the first reference value.

The controlling of the fuel cut may control the fuel cut so as to start the released fuel cut or control the fuel cut so as to release the starting fuel cut.

The measuring of the vehicle tilt may measure the vehicle tilt based on a vehicle tilt angle to a gravity direction by using at least one of a tilt sensor attached to a body or wheel of the vehicle, a tilt angle sensor mounted in the vehicle, and a gravity sensor attached to a handle of the vehicle.

The measuring of the accelerator pressurization may measure the accelerator pressurization by using the pressure sensor attached to one surface of the accelerator to which body wearing is touched or the acceleration sensor attached to one side of the accelerator.

The method for processing a fuel cut further includes: a data storing step of storing, as data, a clearance angle allowable range of the accelerator to each vehicle tilt; a fifth determining step of determining whether a clearance angle measured every time the vehicle tilt and the clearance angle of the accelerator are measured is in a clearance angle allowable range to the measured vehicle tilt; and a haptic step of moving the accelerator when the measured clearance angle is out of the clearance angle allowable range to the measured vehicle tilt. The haptic step may move the accelerator when the released fuel cut starts.

According to the exemplary embodiments of the present invention, it is possible to reflect the driving habit or acceleration intention of a driver by interlocking the clearance angle of the acceleration pedal in addition to starting or releasing the fuel cut according to the tilt angle of the vehicle. It is also possible to increase the convenience of driving while performing the fuel efficiency operation by starting or releasing the fuel cut using the tilt angle of the vehicle and the clearance angle of the acceleration pedal.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
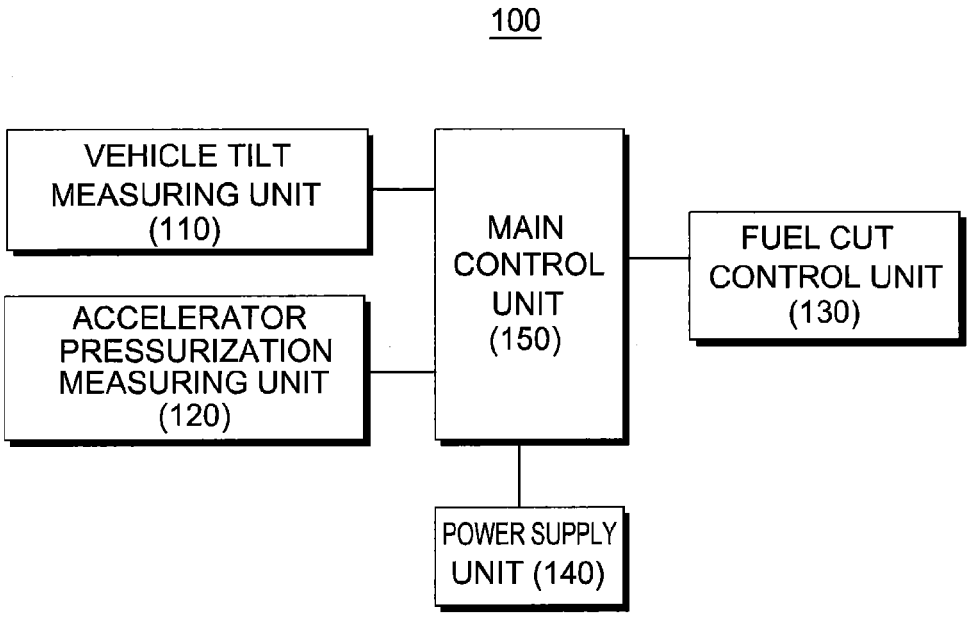
FIG. 1 is a block diagram schematically showing an apparatus for processing a fuel cut according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. It is to be noted that in giving reference numerals to components of each of the accompanying drawing, like reference numerals refer to like elements even though the like components are shown in different drawings. In describing exemplary embodiments of the present invention, well-known functions or constructions will not be described in detail since they may unnecessarily obscure the understanding of the present invention. The exemplary embodiment of the present invention will be described below, but the technical idea of the present invention is not limited thereto and may be modified and variously practiced by those skilled in the art.

FIG. 1 is a block diagram schematically showing an apparatus for processing a fuel cut according to an exemplary embodiment of the present invention. Referring to FIG. 1, an apparatus 100 for processing a fuel cut includes a vehicle tilt measuring unit 110, an accelerator pressurization measuring unit 120, a fuel cut control unit 130, a power supply unit 140, and a main control unit 150.

The vehicle tilt measuring unit 110 serves to measure a vehicle tilt showing a tilt degree of a vehicle. The vehicle tilt measuring unit 110 may measure the vehicle tilt by using at least one of a tilt sensor, a tilt angle sensor, and a gravity sensor. In this configuration, the vehicle tilt measuring unit 110 may measure a vehicle tilt based on a tilt angle of a vehicle to a gravity direction. The tilt sensor may be attached to a body or a wheel of a vehicle, the tilt angle sensor may be mounted in a vehicle, and the gravity sensor may be attached to a handle of a vehicle. However, in the exemplary embodiment of the present invention, the mounted/attached positions, such as the tilt sensor, the tilt angle sensor, the gravity sensor, and the like, are not necessarily limited thereto. Meanwhile, the vehicle tilt measuring unit 110 may measure the vehicle tilt by using a Gyro sensor.

The accelerator pressurization measuring unit 120 serves to measure a degree in which an accelerator of a vehicle is pressed or accelerator pressurization showing a clearance angle of an accelerator. The accelerator pressurization measuring unit 120 may measure the accelerator pressurization by using a pressure sensor or a gravity sensor. The pressure sensor may be attached to one surface of the accelerator to which body wearing is touched and the gravity sensor may be attached to one side of the accelerator. However, in the exemplary embodiment of the present invention, the attached position of the pressure sensor and the gravity sensor is not necessarily limited thereto. Meanwhile, the accelerator pressurization measuring unit 120 may measure the accelerator pressurization by using the Gyro sensor.

The fuel cut control unit 130 serves to control the fuel cut for a vehicle by using the measured vehicle tilt and the measured accelerator pressurization. The fuel cut control unit 130 controls the fuel cut so as to start the released fuel cut or controls the fuel cut so as to release the starting fuel cut.

Figure 2A:
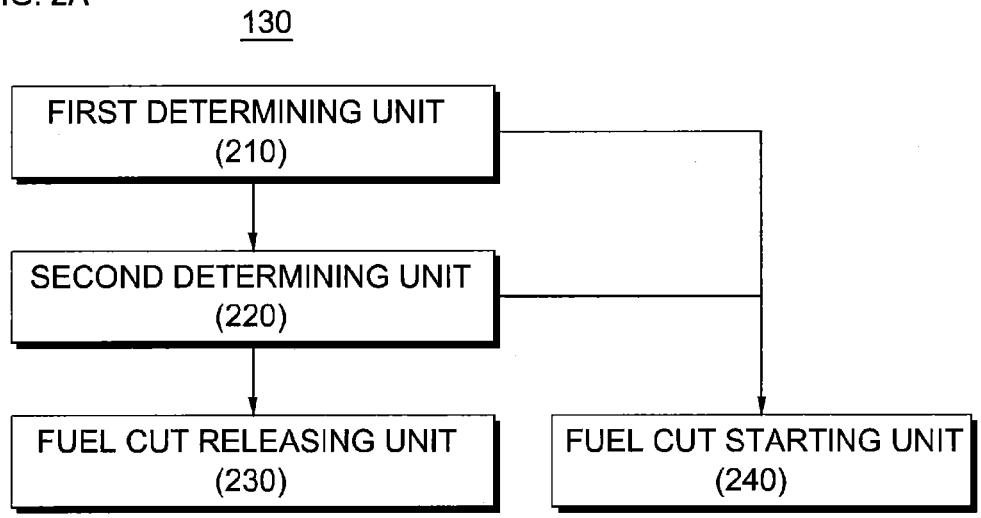
FIGS. 2A and 2B are a block diagram showing internal components of a fuel cut control unit according to various exemplary embodiments shown in FIG. 1.
Figure 2B:
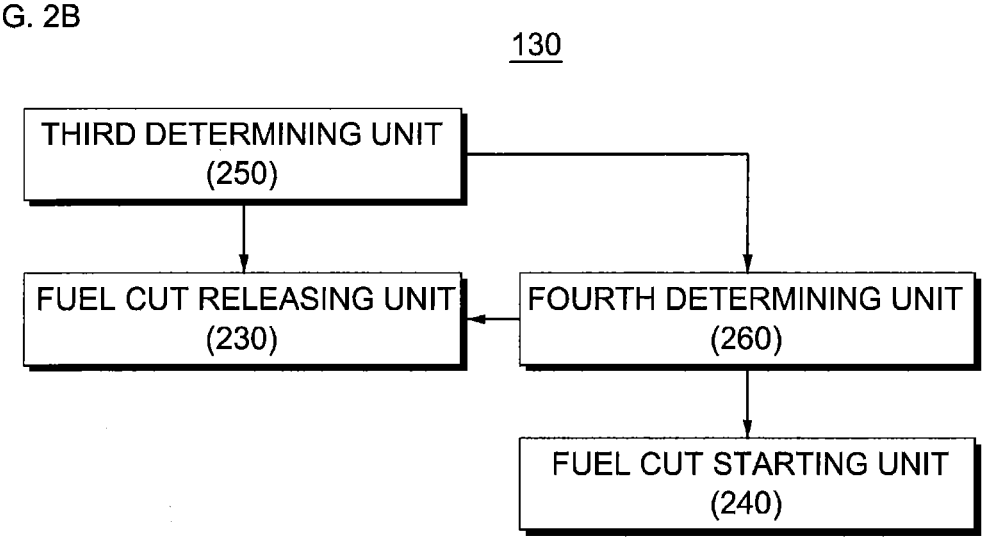

FIGS. 2A and 2B are a block diagram showing internal components of a fuel cut control unit according to various exemplary embodiments shown in FIG. 1. The fuel cut control unit 130 may include a first determining unit 210, a second determining unit 220, and a fuel cut releasing unit 230, as shown in FIG. 2A. The fuel cut control unit 130 may further include a fuel cut starting unit 240.

The first determining unit 210 compares the measured vehicle tilt with a predetermined first reference value to serve to determine whether the measured vehicle tilt is the first reference value or more.

The second determining unit 220 compares the measured accelerator pressurization with a predetermined second reference value when the measured vehicle tilt is the first reference value or more to serve to determine whether the measured accelerator pressurization is less than the second reference value.

The fuel cut releasing unit 230 serves to control the fuel cut so that the starting fuel cut is released when the measured accelerator pressurization is less than the second reference value. The fuel cut releasing unit 230 does not perform any function when the fuel cut is released.

The fuel cut starting unit 240 serves to control the fuel cut so that the released fuel cut starts when the measured vehicle tilt is less than the first reference value or the measured accelerator pressurization is the second reference value or more. The fuel cut starting unit 240 does not perform any function when the fuel cut starts.

The fuel cut control unit 130 of FIG. 2A first uses compared results between the vehicle tilt and the first reference value and uses compared results between the accelerator pressurization and the second reference value later, thereby controlling the fuel cut for the vehicle. However, the fuel cut control unit 130 first uses compared results between the accelerator pressurization and the second reference value and uses compared results between the vehicle tilt and the first reference value later, thereby controlling the fuel cut for the vehicle. The fuel cut control unit 130 is as shown in FIG. 2B.

The fuel cut control unit 130 may include a third determining unit 250 and the fuel cut releasing unit 230, as shown in FIG. 2B. The fuel cut control unit 130 may further include a fourth determining unit 260 and the fuel cut starting unit 240.

The third determining unit 250 compares the measured accelerator pressurization with the predetermined second reference value to serve to determine whether the measured accelerator pressurization is the second reference value or more.

The fuel cut releasing unit 230 serves to control the fuel cut so that the starting fuel cut is released when the measured accelerator pressurization is the second reference value or more. The fuel cut releasing unit 230 does not perform any function when the fuel cut is released.

The fourth determining unit 260 compares the measured vehicle tilt with the predetermined first reference value when the measured accelerator pressurization is less than the second reference value to serve to determine whether the measured vehicle tilt is the first reference value or more.

The fuel cut starting unit 240 controls the fuel cut so that the released fuel cut starts. The fuel cut starting unit 240 serves to control the fuel cut so that the released fuel cut is starts when the measured vehicle tilt is less than the first reference value. The fuel cut starting unit 240 does not perform any function when the fuel cut starts.

When the measured vehicle tilt is the first reference value or more, the fuel cut is controlled so that the fuel cut releasing unit 230 releases the starting fuel cut.

Figure 3:
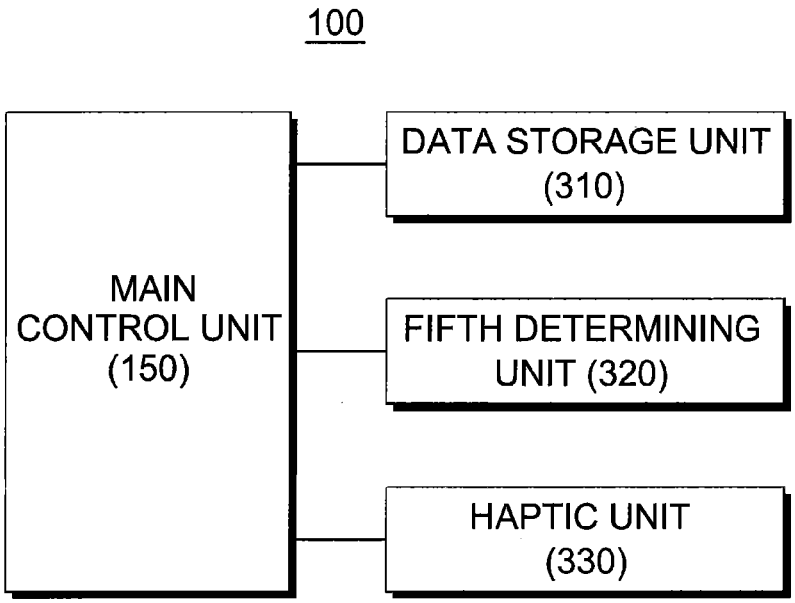
FIG. 3 is a block diagram showing components that are added to the apparatus for processing a fuel cut shown in FIG. 1.

The apparatus 100 for processing a fuel cut may further include a data storage unit, a fifth determining unit, and a haptic unit in addition to the components shown in FIG. 1. FIG. 3 is a block diagram showing components that are added to the apparatus for processing a fuel cut shown in FIG. 1.

A data storage unit 310 stores, as data, a clearance angle allowable range of the accelerator to each vehicle tilt.

The fifth determining unit 320 serves to determine whether the clearance angle measured every time the vehicle tilt and the clearance angle of the accelerator are measured is a value in the clearance angle allowable range to the measured vehicle tilt.

The haptic unit 330 serves to move the accelerator when the measured clearance angle is out of the clearance angle allowable range to the measured vehicle tilt. The haptic unit 330 moves the accelerator when the released fuel cut starts.

Next, the exemplary embodiment of the present invention will describe the apparatus for processing a fuel cut.

Generally, a driver puts his/her own foot on one of the brake pedal and the acceleration pedal. It is a driving method for frequently performing deacceleration and acceleration during the driving. A driver lightly puts his/her own foot on the acceleration pedal even though he/she does not perform acceleration while descending the tilt road. A sensor connected to the acceleration pedal during lightly putting the driver's foot on the acceleration pedal senses the clearance of the pedal to slightly increase a supply of fuel to an engine. Generally, as a tilt angle of a vehicle is increased during the driving of the tilt road, the acceleration applied to the vehicle is increased and as the acceleration intention of the driver is strong, the driver deeply presses on the acceleration pedal and thus, the clearance angle of the acceleration pedal is increased.

Figure 4:
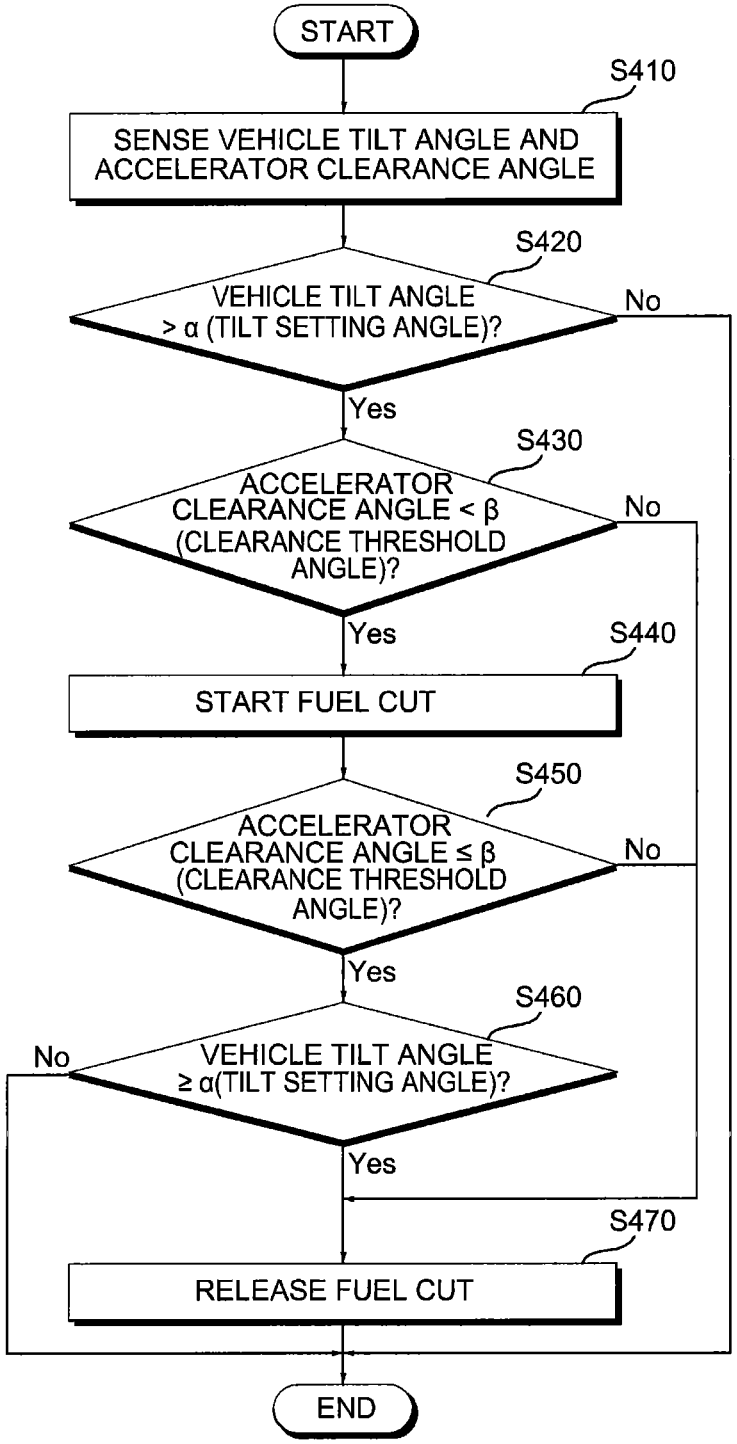
FIG. 4 is a flow chart for describing a function of the apparatus for processing a fuel cut according to the exemplary embodiment of the present invention.

The apparatus for processing a fuel cut takes into account this aspect and effectively and intelligently performs the fuel cut by using the tilt angle of the vehicle and the clearance angle of the acceleration pedal. The apparatus for processing a fuel cut is configured to include a vehicle tilt angle sensor unit measuring the tilt angle of the vehicle, an accelerator clearance angle sensor unit measuring the clearance angle of the acceleration pedal, and a control unit determining the starting and releasing timing of the fuel cut by using input values of the vehicle tilt angle sensor unit and the accelerator clearance angle sensor unit. FIG. 4 is a flow chart for describing a function of the apparatus for processing a fuel cut according to the exemplary embodiment of the present invention.

Each sensor unit senses the vehicle tilt angle and the accelerator clearance angle during the driving of the vehicle (S410). The control unit compares the vehicle tilt angle with a tilt setting angle α to determine that the vehicle drives the tilt road when the vehicle tilt angle is larger than the tilt setting angle (S420) and compares the accelerator clearance angle with a clearance threshold angle β (S430). The control unit determines that the driver has acceleration intention when the accelerator clearance angle is larger than or equal to the clearance threshold angle and even though the fuel cut does not start, when the accelerator clearance angle is smaller than the clearance threshold angle, determines that the driver does not have the acceleration intention of the driver and starts the fuel cut (S440). Meanwhile, the control unit determines that the vehicle drives a level ground when the vehicle tilt angle is smaller than or equal to the tilt setting angle and again perform steps after S410.

The starting fuel cut is maintained until the vehicle tilt angle is the tilt setting angle or less or the accelerator clearance angle is the clearance threshold angle or more. Setting the vehicle tilt angle as the tilt setting angle or less means that the driving on the tilt road ends and setting the accelerator clearance angle as the clearance threshold angle or more means that the acceleration intention of the driver is strong. In this case, the fuel cut is released. That is, the control unit compares the accelerator clearance angle with the clearance threshold angle (S450) to compare the vehicle tilt angle with the tilt setting angle when the accelerator clearance angle is the clearance threshold angle or less (S460). The control unit releases the fuel cut when the vehicle tilt angle is the tilt setting angle or more (S470).

Figure 5:
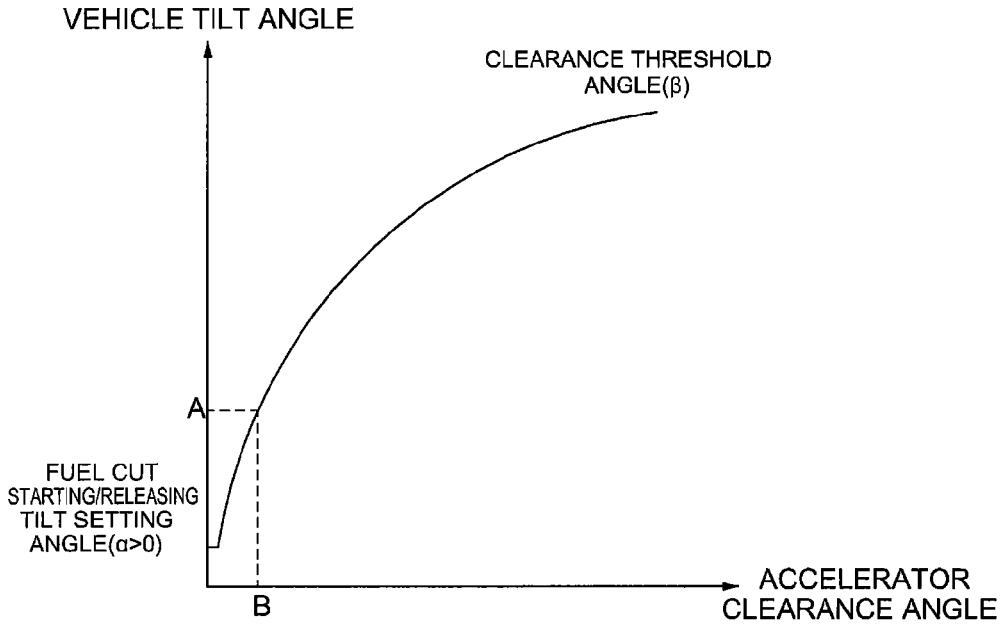
FIG. 5 is a diagram for describing a relation between a tilt setting angle $\alpha$ and a clearance threshold angle $\beta$.

FIG. 5 is a diagram for describing a relation between a tilt setting angle α and a clearance threshold angle β. The tilt setting angle, which determines the starting and releasing of the fuel cut, needs to be larger than 0. When the tilt setting angle is 0, the driving road means a level ground. The clearance threshold angle means a threshold value of the accelerator clearance angle to the current vehicle tilt angle. The clearance threshold angle reflects the acceleration intention of the driver. Therefore, setting the accelerator clearance angle above the clearance threshold angle means that a driver wants acceleration that is acceleration or more generated by natural force.

As shown in FIG. 5, the clearance threshold angle is in a proportional relation to the vehicle tilt angle. That is, when the vehicle tilt angle is small, the acceleration is sensitive and rapidly changed according to the accelerator clearance angle and thus, the clearance threshold angle is small, while when the vehicle tilt angle is large, the acceleration of the vehicle is insensitive and smoothly changed due to the accelerator clearance angle and thus, the clearance threshold angle is large. When the vehicle tilt angle is a predetermined value or more, the accelerator clearance angle does not have large meaning in the acceleration change due to the acceleration generated by natural force applied to the vehicle.

As the exemplary embodiment of the present invention shown in FIG. 4, when the vehicle tilt angle is A, the fuel cut is executed until the accelerator clearance angle is B. When the accelerator clearance angle is B or more, the fuel cut is released and the acceleration is reflected. In this case, when the acceleration sharply rises, the safe driving is threatened and therefore, the acceleration smoothly rises. As the vehicle tilt angle is large, the clearance threshold angle is large and as the vehicle tilt angle is small, the clearance threshold angle is also small. This can operate a function of the fuel cut even thought pressure is slightly applied to the acceleration pedal by allowing a driver to lightly put his/her own foot on the acceleration pedal habitually, thereby increasing the convenience of driving.

Meanwhile, the apparatus for processing a fuel cut may also provide a method for informing to a driver when the accelerator clearance angle exceeds the clearance threshold angle for safe driving. In this case, the control unit transfers to the driver's foot when the acceleration clearance angle exceeds the clearance threshold angle by applying a haptic technology to the acceleration pedal. For example, this can be implemented by a method of vibrating or rattling the acceleration pedal. The method may allow the driver to determine whether the fuel cut is operated and may help improving the fuel efficiency driving habit using the fuel cut.

The apparatus for processing a fuel cut as described above maintains and releases the fuel cut by reflecting the driving habit or acceleration intention of the driver by interlocking the accelerator clearance angle in addition to starting and releasing the fuel cut according to the vehicle tilt angle, thereby increasing the fuel efficiency operation and the convenience of driving and applies the haptic technology, thereby improving the stability of driving.

Figure 6:
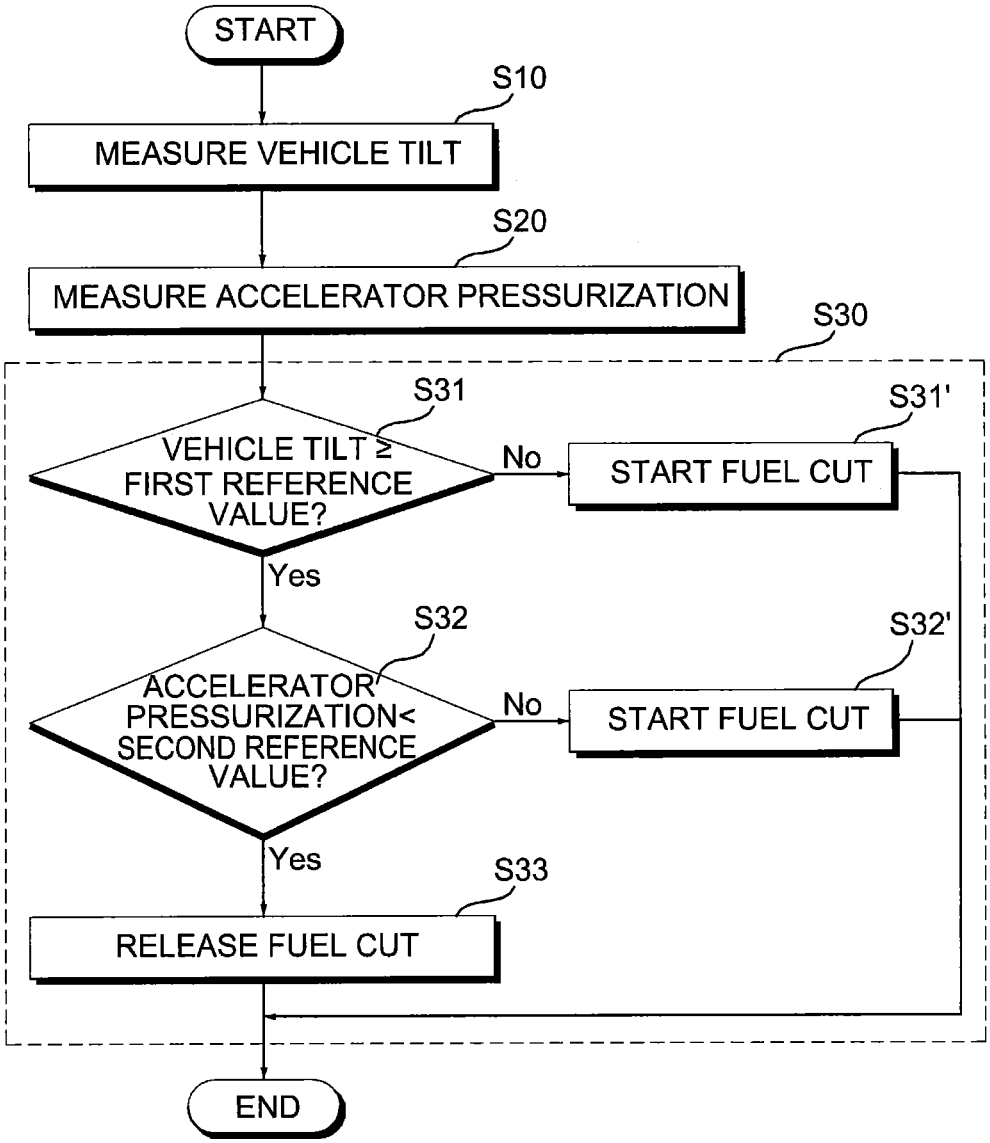
FIG. 6 is a flow chart schematically showing a method for processing a fuel cut according to an exemplary embodiment of the present invention.

Next, the method for processing a fuel cut of the apparatus for processing a fuel cut will be described below. FIG. 6 is a flow chart schematically showing a method for processing a fuel cut according to an exemplary embodiment of the present invention. This will be described below with reference to FIGS. 1 to 3 and FIG. 6.

First, the vehicle tilt measuring unit 110 measures a vehicle tilt showing the tilt degree of the vehicle (S10). The vehicle tilt measuring unit 110 may measure the vehicle tilt based on the tilt angle of the vehicle to the gravity direction by using at least one of the tilt sensor attached to the body or wheel of the vehicle, the tilt angle sensor mounted in the vehicle, and the gravity sensor attached to the handle of the vehicle.

After S10, the accelerator pressurization measuring unit 120 serves to measure a degree in which the accelerator of the vehicle is pressed or the accelerator pressurization showing the clearance angle of the accelerator (S20). The accelerator pressurization measuring unit 120 may measure the accelerator pressurization by using the pressure sensor attached to one surface of the accelerator to which the body wearing is touched or the gravity sensor attached to one side of the accelerator.

After S20, the fuel cut control unit 130 controls the fuel cut for the vehicle by using the measured vehicle tilt and the measured accelerator pressurization (S30). The fuel cut control unit 130 may control the fuel cut so as to start the released fuel cut or control the fuel cut so as to release the starting fuel cut. As described above, S30 may be performed by two schemes.

First, a first scheme is described.

First, the first determining unit 210 compares the measured vehicle tilt with the predetermined first reference value to serve to determine whether the measured vehicle tilt is the first reference value or more (S31). The second determining unit 220 compares the measured accelerator pressurization with the predetermined second reference value when the measured vehicle tilt is the first reference value or more to serve to determine whether the measured accelerator pressurization is less than the second reference value (S32). When the measured accelerator pressurization is less than the second reference value, the fuel cut releasing unit 230 controls the fuel cut so as to release the fuel cut (S33). When the measured vehicle tilt is less than the first reference value or the measured accelerator pressurization is the second reference value or more, the fuel cut starting unit 240 may control the fuel cut so as to start the fuel cut (S31' and S32').

When the measured vehicle tilt is less than the first reference value, step S31' of controlling the fuel cut so as to start the fuel cut may be performed at any time after S31. For example, the step S31' may be executed between steps S31 and S32. When the measured accelerator pressurization is the second reference value or more, step S32' of controlling the fuel cut so as to start the fuel cut may be performed at any time after S32. For example, the step S32' may be executed between steps S32 and S33.

Next, a second scheme is described.

First, the third determining unit 250 compares the measured accelerator pressurization with the predetermined second reference value to serve to determine whether the measured accelerator pressurization is the second reference value or more (a third determining step). When the measured accelerator pressurization is the second reference value or more, the fuel cut releasing unit 230 controls the fuel cut so as to release the fuel cut (a first fuel cut releasing step). On the other hand, the fourth determining unit 260 compares the measured vehicle tilt with the predetermined first reference value when the measured accelerator pressurization is less than the second reference value to serve to determine whether the measured vehicle tilt is the first reference value or more (a fourth determining step). When the measured vehicle tilt is the first reference value or more, the fuel cut releasing unit 230 controls the fuel cut so as to release the fuel cut (a second fuel cut releasing step). On the other hand, when the measure vehicle tilt is less than the first reference value, the fuel cut starting unit 240 controls the fuel cut so as to start the fuel cut (a fuel cut starting step). The fourth determining step and the fuel cut starting step may be performed at any time after the third determining step. For example, the fourth determining step and the fuel cut starting step may be performed between the third determining step and the first fuel cut releasing step.

Meanwhile, the method for processing a fuel cut may further perform a data storing step, a fifth determining step, and a haptic step. The data storing step, which is a step executed by the data storage unit 310, stores the clearance angle allowable range of the accelerator to the each vehicle tilt as data. The fifth determining step, which is a step performed by the fifth determining unit 320, determines whether the clearance angle measured every time the clearance angle between the vehicle tilt and the accelerator is measured is in the clearance angle allowable range to the measured vehicle tilt. The haptic step, which is a step performed by the haptic unit 330, moves the accelerator when the measured clearance angle is out of the clearance angle allowable range to the measured vehicle tilt. The haptic unit 330 may move the accelerator when the released fuel cut starts. The data storing step, the fifth determining step, and the haptic step may be performed after S30.

The apparatus and method for processing a fuel cut as described above may be applied to an embedded system for an intelligent car electronic device or an embedded software flatform. For example, the apparatus and method for processing a fuel cut may be applied to a car electronic control unit (ECU).

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An apparatus for processing a fuel cut, comprising:

a vehicle tilt measuring unit configured to measure a vehicle tilt showing an inclined degree of a vehicle;

an accelerator pressurization measuring unit configured to measure a degree in which an accelerator of the vehicle is pressurized or accelerator pressurization indicating a clearance angle of the accelerator; and a fuel cut control unit configured to control the fuel cut for the vehicle by comparing the measured vehicle tilt with a predetermined first reference value, and comparing the measured accelerator pressurization with a predetermined second reference value, wherein when the measured vehicle tilt is greater than the predetermined first reference value, and when the clearance angle is less than the predetermined second reference value, the fuel cut for the vehicle is started; and wherein the fuel cut is released when the measured vehicle tilt is less than the predetermined first reference value or the clearance angle exceeds the predetermined second reference value.

2. The apparatus of claim 1, wherein the fuel cut control unit controls the fuel cut so as to start the released fuel cut or controls the fuel cut so as to release the starting fuel cut.

3. The apparatus of claim 1, wherein the fuel cut control unit includes:

a first determining unit configured to compare the measured vehicle tilt with the predetermined first reference value to determine whether the measured vehicle tilt is the first reference value or more;

a second determining unit configured to compare the measured accelerator pressurization with the predetermined second reference value when the measured vehicle tilt is the first reference value or more to determine whether the measured accelerator pressurization is less than the second reference value or more; and a fuel cut releasing unit configured to control the fuel cut so as to release the starting fuel cut when the measured acceleration pressurization is less than the second reference value.

4. The apparatus of claim 3, wherein the fuel cut control unit further includes: a fuel cut starting unit configured to control the fuel cut so as to start the released fuel cut when the measured vehicle tilt is less than the first reference value or the measured accelerator pressurization is the second reference value or more.

5. The apparatus of claim 1, wherein the fuel cut control unit includes:

a third determining unit configured to compare the measured acceleration pressurization with the predetermined second reference value to determine whether the measured accelerator pressurization is the second reference value or more; and a fuel cut releasing unit configured to control the fuel cut so as to release the starting fuel cut when the measured accelerator pressurization is the second reference value or more.

6. The apparatus of claim 5, wherein the fuel cut control unit further includes:

a fourth determining unit configured to compare the measured vehicle tilt with the predetermined first reference value when the measured accelerator pressurization is less than the second reference value to determine whether the measured vehicle tilt is the first reference value or more; and a fuel cut starting unit configured to control the fuel cut so as to start the released fuel cut, wherein the fuel cut releasing unit controls the fuel cut so as to release the fuel cut when the measured vehicle tilt is the first reference value or more, and the fuel cut starting unit controls the fuel cut so as to start the fuel cut when the measured vehicle tilt is less than the first reference value.

7. The apparatus of claim 1, wherein the vehicle tilt measuring unit measures the vehicle tilt based on a vehicle tilt angle to a gravity direction by using at least one of a tilt sensor attached to a body or wheel of the vehicle, a tilt angle sensor mounted in the vehicle, and a gravity sensor attached to a handle of the vehicle.

8. The apparatus of claim 1, wherein the accelerator pressurization measuring unit measures the accelerator pressurization by using the pressure sensor attached to one surface of the accelerator to which body wearing is touched or the gravity sensor attached to one side of the accelerator.

9. The apparatus of claim 1, further comprising:

a data storage unit configured to store, as data, a clearance angle allowable range of the accelerator to each vehicle tilt;

a fifth determination unit configured to determine whether a clearance angle measured every time the vehicle tilt and the clearance angle of the accelerator are measured is in a clearance angle allowable range to the measured vehicle tilt; and a haptic unit configured to move the accelerator when the measured clearance angle is out of the clearance angle allowable range to the measured vehicle tilt.

10. The apparatus of claim 9, wherein the haptic unit moves the accelerator when the released fuel cut starts.

11. A method for processing a fuel cut, comprising:

measuring a vehicle tilt showing an inclined degree of a vehicle;

measuring a degree in which an accelerator of the vehicle is pressurized or accelerator pressurization indicating a clearance angle of the accelerator; and controlling the fuel cut for the vehicle by comparing the measured vehicle tilt with a predetermined first reference value, and comparing the measured accelerator pressurization with a predetermined second reference value, starting the fuel cut when the measured vehicle tilt is greater than the predetermined first reference value, and when the clearance angle is less than the predetermined second reference value; and releasing the fuel cut when the measured vehicle tilt is less than the predetermined first reference value or the clearance angle exceeds the predetermined second reference value.

12. The method of claim 11, wherein the controlling of the fuel cut includes:

a first determining step of comparing the measured vehicle tilt with the predetermined first reference value to determine whether the measured vehicle tilt is the first reference value or more;

a second determining step of comparing the measured accelerator pressurization with the predetermined second reference value when the measured vehicle tilt is the first reference value or more to determine whether the measured accelerator pressurization is less than the second reference value or more; and a fuel cut releasing step of controlling the fuel cut so as to release the starting fuel cut when the measured acceleration pressurization is less than the second reference value.

13. The method of claim 12, wherein the controlling of the fuel cut further includes: a fuel cut starting step of controlling the fuel cut so as to start the released fuel cut when the measured vehicle tilt is less than the first reference value or the measured accelerator pressurization is the second reference value or more.

14. The method of claim 11, wherein the controlling of the fuel cut includes:

a third determining step of comparing the measured acceleration pressurization with the predetermined second reference value to determine whether the measured accelerator pressurization is the second reference value or more; and a fuel cut releasing step of controlling the fuel cut so as to release the starting fuel cut when the measured accelerator pressurization is the second reference value or more.

15. The method of claim 14, wherein the controlling of the fuel cut further includes:

a fourth determining step of comparing the measured vehicle tilt with the predetermined first reference value when the measured accelerator pressurization is less than the second reference value to determine whether the measured vehicle tilt is the first reference value or more; and a fuel cut starting step of controlling the fuel cut so as to start the released fuel cut, wherein the fuel cut releasing step controls the fuel cut so as to release the fuel cut when the measured vehicle tilt is the first reference value or more, and the fuel cut starting step controls the fuel cut so as to start the fuel cut when the measured vehicle tilt is less than the first reference value.

16. A method for processing a fuel cut, comprising:

measuring a vehicle tilt showing an inclined degree of a vehicle;

measuring a degree in which an accelerator of the vehicle is pressurized or accelerator pressurization indicating a clearance angle of the accelerator;

starting the fuel cut for the vehicle when the measured vehicle tilt is greater than a tilt setting angle, and when the clearance angle is less than a clearance threshold angle; and releasing the fuel cut when the measured vehicle tilt is less than the tilt setting angle.

* * * * *